US011605492B2

(12) United States Patent
Kaneko et al.

(10) Patent No.: US 11,605,492 B2
(45) Date of Patent: Mar. 14, 2023

(54) COIL COMPONENT

(71) Applicant: TDK CORPORATION, Tokyo (JP)

(72) Inventors: Shigeru Kaneko, Tokyo (JP); Toshio Tomonari, Tokyo (JP); Junpei Hayama, Tokyo (JP); Tomohiro Moriki, Tokyo (JP); Noritaka Chiyo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 1024 days.

(21) Appl. No.: 16/185,448

(22) Filed: Nov. 9, 2018

(65) Prior Publication Data

US 2019/0148053 A1 May 16, 2019

(30) Foreign Application Priority Data

Nov. 13, 2017 (JP) ..... JP2017-218104
Jul. 13, 2018 (JP) ..... JP2018-133102

(51) Int. Cl.

| | |
|---|---|
| ***H01F 27/28*** | (2006.01) |
| ***H01F 27/00*** | (2006.01) |
| ***H01F 27/29*** | (2006.01) |
| ***H01F 5/04*** | (2006.01) |
| ***H01F 5/00*** | (2006.01) |

(52) U.S. Cl.

CPC ..... *H01F 27/2804* (2013.01); *H01F 5/003* (2013.01); *H01F 5/04* (2013.01); *H01F 27/006* (2013.01); *H01F 27/29* (2013.01)

(58) Field of Classification Search

CPC ..... H01F 17/0013; H01F 2027/2809; H01F 17/0006; H01F 27/2804; H01F 5/003; H01F 27/29; H01F 27/292; H01F 2017/0073; H01F 2017/0046; H01F 27/006; H01F 27/04

USPC ..... 336/192, 200, 232

See application file for complete search history.

(56) References Cited

U.S. PATENT DOCUMENTS

| | | | | |
|---|---|---|---|---|
| 7,417,523 | B2 * | 8/2008 | Waffenschmidt | H05K 1/165 336/200 |
| 2003/0179067 | A1 | 9/2003 | Gamou et al. | |
| 2009/0085707 | A1 | 4/2009 | Mi et al. | |
| 2009/0309579 | A1 * | 12/2009 | Cochran | A61B 5/113 324/207.16 |
| 2011/0050380 | A1 * | 3/2011 | Nakanishi | H01F 27/341 336/200 |

(Continued)

FOREIGN PATENT DOCUMENTS

| | | | |
|---|---|---|---|
| JP | 06236821 | A * | 8/1994 |
| JP | 07272934 | A * | 10/1995 |

(Continued)

*Primary Examiner* — Tszfung J Chan
(74) *Attorney, Agent, or Firm* — Young Law Firm, P.C.

(57) ABSTRACT

Disclosed herein is a coil component that includes a first coil part spirally wound in a plurality of turns, the first coil part including a first turn positioned at an innermost periphery and a second turn positioned on an outer peripheral side relative to the first turn; and a second coil part spirally wound in a plurality of turns, the second coil part including a third turn positioned at an innermost periphery and a fourth turn positioned on an outer peripheral side relative to the third turn. The first turn and the fourth turn are connected to each other, and the second turn and the third turn are connected to each other.

5 Claims, 16 Drawing Sheets

(56) References Cited

U.S. PATENT DOCUMENTS

| | | | | |
|---|---|---|---|---|
| 2013/0293337 | A1* | 11/2013 | Lo | H01F 41/041 336/200 |
| 2013/0300529 | A1 | 11/2013 | Chang et al. | |
| 2013/0335186 | A1 | 12/2013 | Chang et al. | |
| 2017/0207020 | A1* | 7/2017 | Hamada | H01F 17/0013 |

FOREIGN PATENT DOCUMENTS

| | | | | |
|---|---|---|---|---|
| JP | 11135327 | A | 5/1999 | |
| JP | 11-307367 | A | 11/1999 | |
| JP | 2006-173163 | A | 6/2006 | |
| JP | 2008205215 | A | 9/2008 | |
| WO | WO-9843258 | A2 * | 10/1998 | H01F 17/0006 |

* cited by examiner

COIL COMPONENT

BACKGROUND OF THE INVENTION

Field of the Invention

The present invention relates to a coil component and, more particularly, to a coil component having a spiral-shaped planar conductor.

Description of Related Art

As a coil component used for various electronic devices, a coil component of a type in which a wire (coated wire) is wound around a magnetic core and, further, a coil component of a type in which a spiral-shaped planar conductor of a plurality of turns is formed on an insulating layer are known. For example, JP 2008-205215 A discloses a coil component having a configuration in which spiral-shaped coil parts are formed on a plurality of insulating layers, respectively, and the inner peripheral ends thereof are connected to one another.

However, in the coil component described in JP 2008-205215 A, when the number of turns of the coil part formed on each insulating layer is an integer value, the total number of turns is inevitably even. That is, failing to set the total number of turns to an odd number makes it difficult to perform fine adjustment of a parameter such as inductance or resistance.

SUMMARY

It is therefore an object of the present invention to provide a coil component in which the total number of turns can be set to an odd number even when the number of turns of each coil part is an integer value.

A coil component according to an aspect of the present invention includes a first coil part spirally wound in a plurality of turns and a second coil part spirally wound in a plurality of turns. The first coil part includes a first turn positioned at the innermost periphery and a second turn positioned on the outer peripheral side relative to the first turn. The second coil part includes a third turn positioned at the innermost periphery and a fourth turn positioned on the outer peripheral side relative to the third turn. The first turn and the fourth turn are connected to each other, and the second turn and the third turn are connected to each other.

According to the present invention, the first and fourth turns are connected to each other, and the second and third turns are connected to each other, so that even when the number of turns of each coil part is an integer value, the total number of turns can be set to an odd number. This allows a parameter such as inductance or resistance to be adjusted.

In the present invention, the conductor width of the first turn may be smaller than that of the second turn, and the conductor width of the third turn may be smaller than that of the fourth turn. This can reduce a variation in the effective conductor width between the turns. When the turn is separated into a plurality of lines, the "conductor width" refers to a total conductor width obtained by summing the conductor widths of the lines.

In the present invention, the turns of the first coil part other than the first turn may each be radially separated into first and second lines by a spiral-shaped slit, and the turns of the second coil part other than the third turn may each be radially separated into first and second lines by a spiral-shaped slit. This uniformizes current density distribution, allowing further reduction in DC resistance or AC resistance.

In the present invention, the first line may be positioned on the outer peripheral side relative to the second line, the first turn of the first coil part may be a turn continued from the first line of the second turn, and the third turn of the second coil part may be a turn continued from the first line of the fourth turn. This can increase the number of turns of a conductor continued to the first or third turn by one turn as compared to the number of turns of the second line.

In the present invention, the first turn of the first coil part may be connected to the second line of the fourth turn, and the third turn of the second coil part may be connected to the second line of the second turn. As a result, the first line of the first coil part is connected to the second line of the second coil part, and the second line of the first coil part is connected to the first line of the second coil part, thereby canceling the inner/outer peripheral difference. This reduces the difference between the electrical lengths of two conductors connected in parallel, making it possible to further reduce DC resistance or AC resistance.

In the present invention, the first turn of the first coil part may be radially separated into third and fourth lines by a spiral-shaped slit, the third turn of the second coil part may be radially separated into third and fourth lines by a spiral-shaped slit, the turns of the first coil part other than the first turn may be radially separated into first, second, fifth, and sixth lines by spiral-shaped slits, and the turns of the second coil part other than the third turn may be radially separated into first, second, fifth, and sixth lines by spiral-shaped slits. This further uniformizes current density distribution, allowing further reduction in DC resistance or AC resistance.

In the present invention, the third line may be positioned on the outer peripheral side relative to the fourth line, the first, fifth, sixth, and second lines may be arranged in this order from the outer peripheral side to the inner peripheral side, the third line of the first turn may be a turn continued from the first line of the second turn, the fourth line of the first turn may be a turn continued from the fifth line of the second turn, the third line of the third turn may be a turn continued from the first line of the fourth turn, and the fourth line of the third turn may be a turn continued from the fifth line of the fourth turn. This can increase the number of turns of a conductor continued to the third or fourth turn by one turn as compared to the number of turns of the second line or sixth line.

In the present invention, the third line of the first turn may be connected to the second line of the fourth turn, the fourth line of the first turn may be connected to the sixth line of the fourth turn, the third line of the third turn may be connected to the second line of the second turn, and the fourth line of the third turn may be connected to the sixth line of the second turn. This allows the peripheral positions between the first and second coil parts to be completely interchanged, thereby canceling the inner/outer peripheral difference more correctly. This reduces the difference between the electrical lengths, allowing further reduction in DC resistance or AC resistance.

In the present invention, the turns of the first coil part other than the first turn may each be radially separated into first, second, and third lines by spiral-shaped slits, the turns of the second coil part other than the third turn may each be radially separated into fourth, fifth, and sixth lines by spiral-shaped slits, the first turn of the first coil part may be radially separated into first and second lines by a spiral-shaped slit, the third turn of the second coil part may be radially separated into fourth and fifth lines by a spiral-shaped slit, the first line of the first turn may be a turn continued from the first line of the second turn, the second line of the first turn may be a turn continued from the second line of the second turn, the fourth line of the third turn may be a turn continued from the fourth line of the fourth turn, the fifth line of the third turn may be a turn continued from the fifth line of the fourth turn, the first line of the first turn may be connected to the sixth line of the fourth turn, the second line of the first turn may be connected to the fifth line of the fourth turn, the second line of the second turn may be connected to the fifth line of the third turn, and the third line of the second turn may be connected to the fourth line of the third turn. With this configuration, the turns other than the innermost turn are each separated into three lines. This uniformizes current density distribution, allowing reduction in DC resistance or AC resistance. In addition, the peripheral positions are completely interchanged between the first and second coil parts, thereby canceling the inner/outer peripheral difference more correctly.

In the present invention, the conductor width of the second line of the first turn and that of the fifth line of the third turn may be smaller than the conductor width of the first line of the first turn and that of the fourth line of the third turn, respectively. This can suppress local reduction in the resistance value at a parallel connection section.

In the present invention, the conductor widths of the lines constituting the first and third turns may be smaller than the conductor widths of the lines constituting the second and fourth turns. This reduces eddy current generated at the innermost turn having strong magnetic flux, making it possible to reduce loss generated due to heat generation.

In the present invention, the first coil part may be formed on one surface of an insulating substrate, and the second coil part may be formed on the other surface of the insulating substrate. Thus, by forming the first and second coil parts on the front and back surfaces of a single insulating substrate, the coil component according to the present invention can be obtained.

In the present invention, the plurality of turns constituting the first and second coil parts may each have a circumferential region in which the radial position is not changed and a shift region in which the radial position is shifted, and the circumferential regions of the plurality of turns constituting the first coil part and the circumferential regions of a plurality of turns constituting the second coil part may coincide with each other in planar position. This facilitates outer appearance inspection when the insulating substrate is transparent or translucent.

A coil component according to another aspect of the present invention includes a first coil part spirally wound in a plurality of turns and a second coil part spirally wound in a plurality of turns. The first coil part has a section connecting a first innermost peripheral end and a first connection part, and the second coil part has a section connecting a second innermost peripheral end and a second connection part. The first inner peripheral end and the second connection part are connected to each other, and the second inner peripheral end and the first connection part are connected to each other.

According to the present invention, the section connecting the first innermost peripheral end and the first connection part and the section connecting the second innermost peripheral end and the second connection part are connected in parallel, so that when the above sections each have one turn, the total number of turns of the sections can be regarded as one turn. This makes it possible to set the total number of turns to an odd number, allowing fine adjustment of the number of turns.

In the present invention, the first coil part may be separated, by spiral-shaped slits, into a plurality of lines including a first line, a second line positioned on the inner peripheral side relative to the first line, and a third line positioned on the inner peripheral side relative to the second line, the second coil part may be separated, by spiral-shaped slits, into a plurality of lines including a fourth line, a fifth line positioned on the inner peripheral side relative to the fourth line, and a sixth line positioned on the inner peripheral side relative to the fifth line, the innermost turn of the first coil part may include the first and second lines, the innermost turn of the second coil part may include the fourth and fifth lines, the end point of the innermost turn of the first line and the end point of the innermost turn of the sixth line may be connected to each other, the end point of the innermost turn of the third line and the end point of the innermost turn of the fourth line may be connected to each other, the first innermost peripheral end which is the end point of the innermost turn of the second line and the second connection part existing on the fifth line may be connected to each other, and the second innermost peripheral end which is the end point of the innermost turn of the fifth line and the first connection part existing on the second line may be connected to each other. This makes it possible to equalize the effective numbers of turns among the lines while separating each of turns constituting the first and second coil parts into odd number lines. In addition, the peripheral positions are completely interchanged between the first and second coil parts, thereby canceling the inner/outer peripheral difference correctly.

In the present invention, the first connection part may be positioned at the start point of the innermost turn of the second line, and the second connection part may be positioned at the start point of the innermost turn of the fifth line. With this configuration, the section connecting the first innermost peripheral end and the first connection part and the section connecting the second innermost peripheral end and the second connection part form one turn in total, so that even when the number of turns of each of the first and second coil parts is an integer value, it is possible to set the total number of turns to an odd number.

In the present invention, the pattern width of the innermost turn of the second line may be smaller than that of the innermost turn of the first line, and the pattern width of the innermost turn of the fifth line may be smaller than that of the innermost turn of the fourth line. This can suppress local reduction in the resistance value at a parallel connection section.

As described above, according to the present invention, there can be provided a coil component in which the total number of turns can be set to an odd number even when the number of turns of each coil part is an integer value.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

First Embodiment

Figure 1:
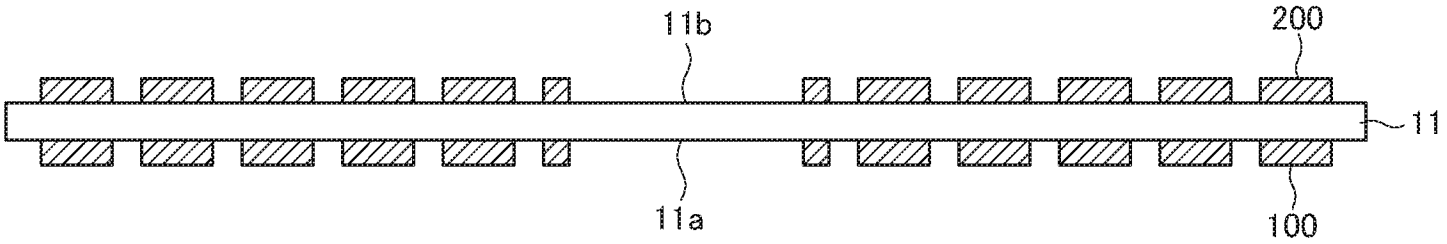
FIG. 1 is a cross-sectional view illustrating the configuration of a coil component according to a first embodiment of the present invention.

FIG. 1 is a cross-sectional view illustrating the configuration of a coil component according to the first embodiment of the present invention.

As illustrated in FIG. 1, the coil component according to the present embodiment includes an insulating substrate 11, a first coil part 100 formed on one surface 11*a* of the insulating substrate 11, and a second coil part 200 formed on the other surface 11*b* of the insulating substrate 11. Although details will be described later, the inner peripheral end of the first coil part 100 and the inner peripheral end of the second coil part 200 are connected to each other through a connection part penetrating the insulating substrate 11.

Although there is no particular restriction on the material of the insulating substrate 11, a transparent or translucent flexible material such as PET resin may be used. Alternatively, the insulating substrate 11 may be a flexible substrate obtained by impregnating glass cloth with epoxy-based resin. When the insulating substrate 11 is transparent or translucent, the first coil part 100 and the second coil part 200 are seen overlapping each other in a plan view. Thus, outer appearance inspection using an outer appearance inspection device becomes difficult depending on how they overlap each other. Although details will be described later, in the coil component according to the present embodiment, the first and second coil parts 100 and 200 are disposed overlapping each other for the most part so as to allow outer appearance inspection using an outer appearance inspection device to be executed properly.

Figure 2:
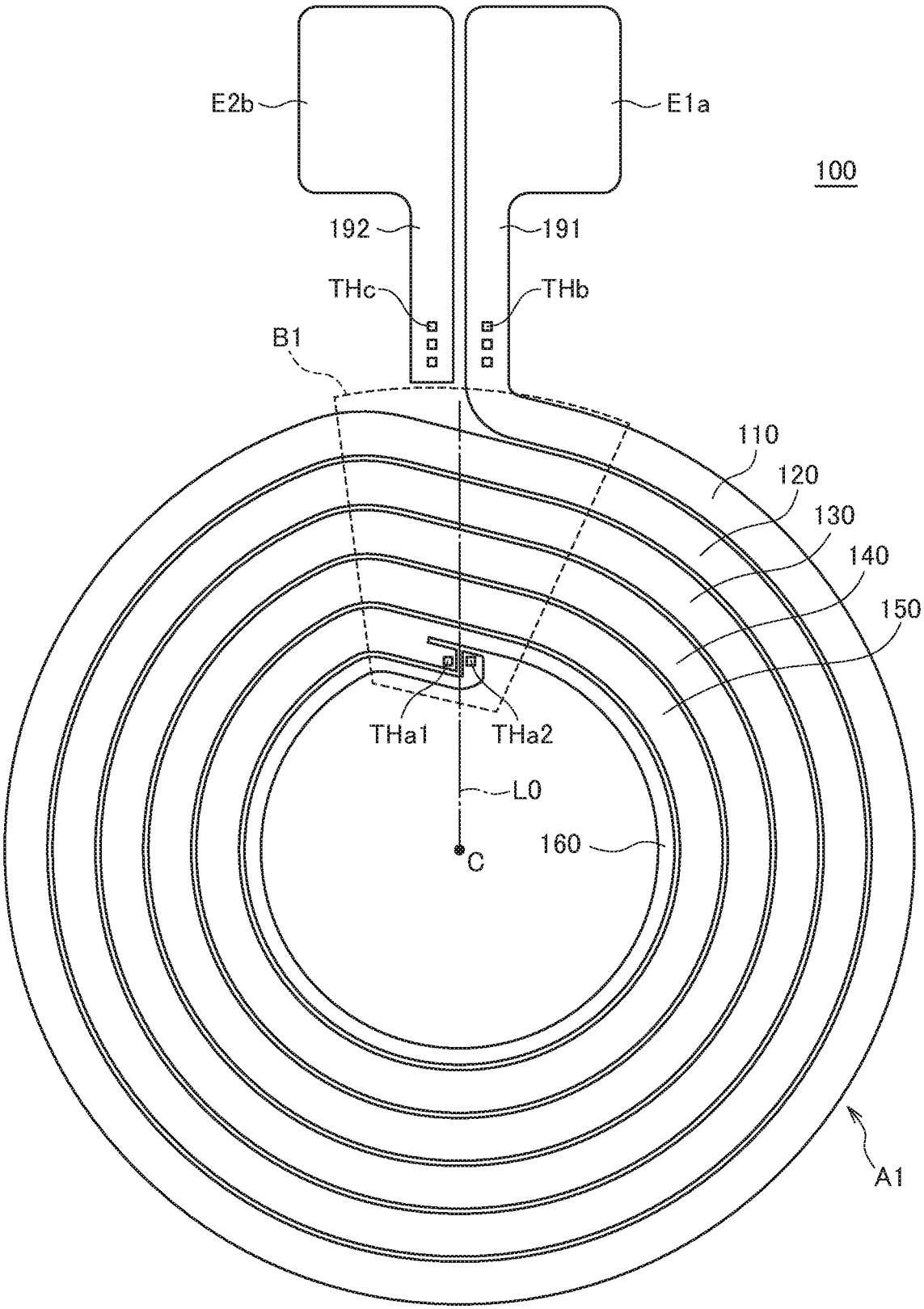
FIG. 2 is a plan view illustrating the pattern shape of a first coil part according to the first embodiment of the present invention.

FIG. 2 is a plan view illustrating the pattern shape of the first coil part 100 as viewed from the surface 11*a* side of the insulating substrate 11.

As illustrated in FIG. 2, the first coil part 100 is constituted of a planar conductor spirally wound in a plurality of turns. In the example of FIG. 2, the first coil part 100 has six turns including turns 110, 120, 130, 140, 150, and 160, in which the turns 110 and 160 are positioned at the outermost and innermost peripheries, respectively. The outer peripheral end of the first coil part 100 is connected to a terminal electrode E1*a* through a radially extending lead-out pattern 191. Further, a radially extending lead-out pattern 192 is provided peripherally adjacent to the lead-out pattern 191, and the leading end portion thereof is connected to a terminal electrode E2*b*.

The innermost turn 160 has a conductor width smaller than those of the other turns 110 to 150. Preferably, the conductor width of the turn 160 is half those of the turns 110, 120, 130, 140, and 150. The second innermost turn 150 is branched into two parts at the inner peripheral end thereof, and one of the branched parts is connected to a connection part THa1, and the other one thereof is continuously wound to constitute the turn 160. The inner peripheral end of the turn 160 is connected to a connection part THa2.

The turns 110, 120, 130, 140, 150, and 160 constituting the first coil part 100 each have a circumferential region A1 in which the radial position is not changed and a shift region B1 in which the radial position is shifted. The six turns including the turns 110, 120, 130, 140, 150, and 160 are defined with the shift region B1 as a boundary. As illustrated in FIG. 2, in the present embodiment, both the outer peripheral end and the inner peripheral end of the first coil part 100 are positioned within the shift region B1. Further, when a virtual line L0 radially extending from a center point C of the first coil part 100 and passing between the lead-out patterns 191 and 192 is drawn, the shift region B1 is positioned on the virtual line L0. The connection parts THa1 and THa2 are formed so as to be symmetrical with respect to the virtual line L0.

Figure 3:
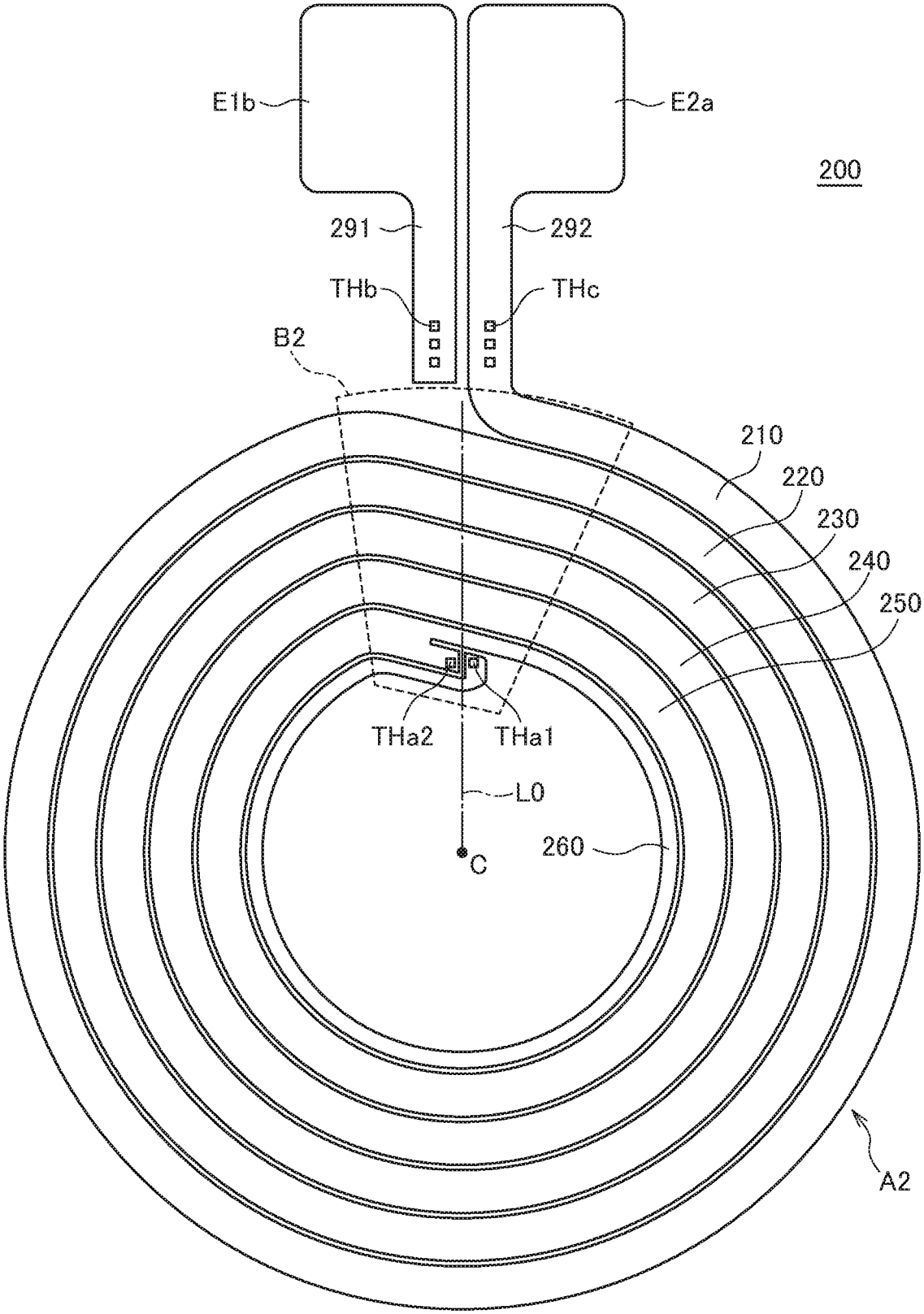
FIG. 3 is a plan view illustrating the pattern shape of a second coil part according to the first embodiment of the present invention.

FIG. 3 is a plan view illustrating the pattern shape of the second coil part 200 as viewed from the surface 11*b* side of the insulating substrate 11.

As illustrated in FIG. 3, the second coil part 200 has the same pattern shape as that of the first coil part 100. Accordingly, the first and second coil parts 100 and 200 can be manufactured using the same mask, allowing manufacturing cost to be significantly reduced. The second coil part 200 has six turns including turns 210, 220, 230, 240, 250, and to 260, in which the turns 210 and 260 are positioned at the outermost and innermost peripheries, respectively. The outer peripheral end of the second coil part 200 is connected to a terminal electrode E2*a* through a radially extending lead-out pattern 292. Further, a radially extending lead-out pattern 291 is provided peripherally adjacent to the lead-out pattern 292, and the leading end portion thereof is connected to a terminal electrode E1*b*.

As described above, the first and second coil parts 100 and 200 have the same planar shape, so that the innermost turn 260 has a conductor width smaller than those of the other turns 210, 220, 230, 240, and 250. Further, the second innermost turn 250 is branched into two parts at the inner peripheral end thereof, and one of the branched parts is connected to the connection part THa2, and the other one thereof is continuously wound to constitute the turn 260. The inner peripheral end of the turn 260 is connected to the connection part THa1.

The turns 210, 220, 230, 240, 250, and 260 constituting the second coil part 200 each have a circumferential region A2 in which the radial position is not changed and a shift region B2 in which the radial position is shifted. The first and second coil parts 100 and 200 have the same planar shape, so that the virtual line L0 passes between the outer peripheral end of the first coil part 100 and the outer peripheral end of the second coil part 200.

The thus configured first and second coil parts 100 and 200 are formed on the surfaces 11*a* and 11*b* of the insulating substrate 11, respectively.

Figure 4:
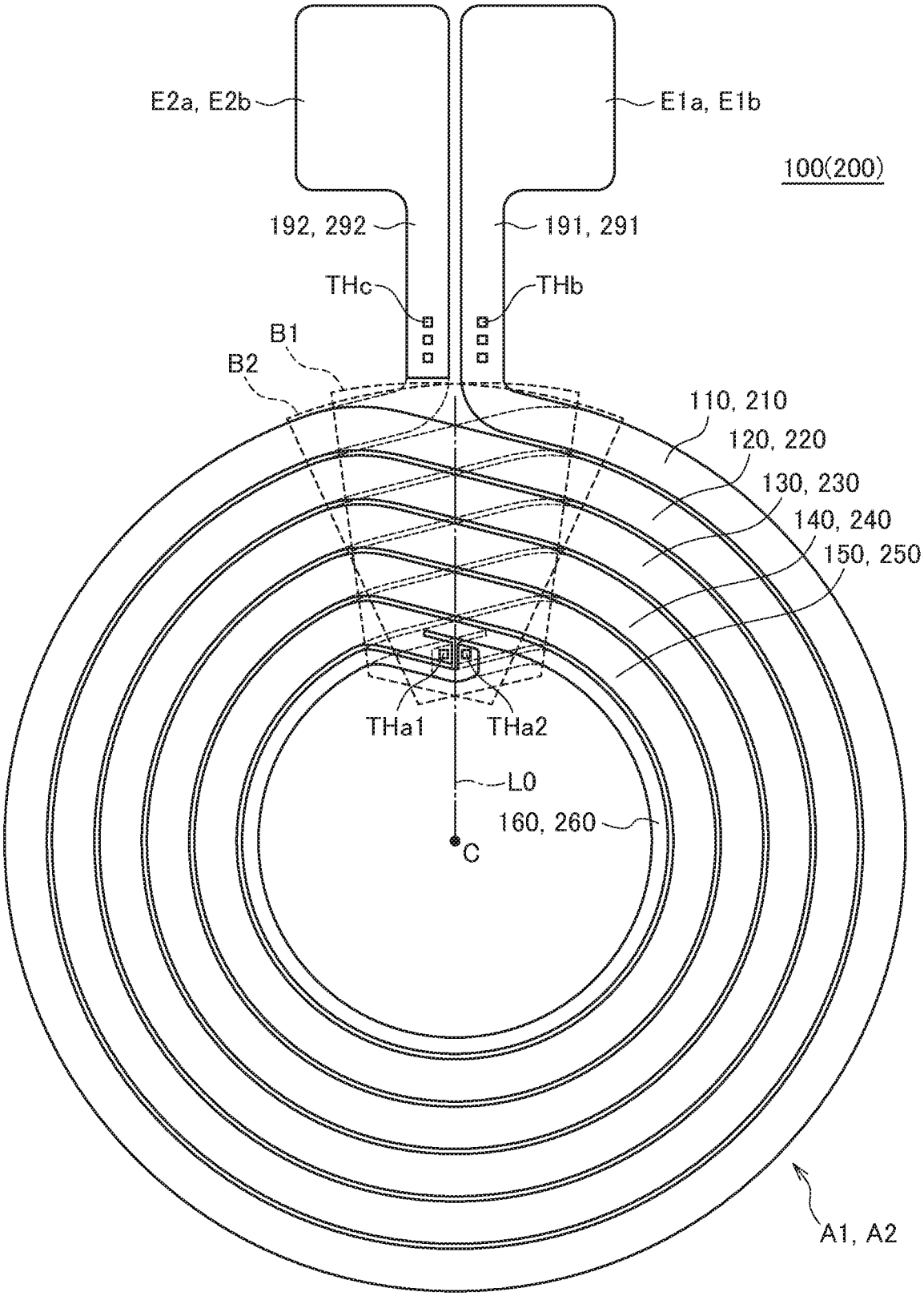
FIG. 4 is a transparent plan view illustrating how the first and second coil parts overlap each other.

FIG. 4 is a transparent plan view illustrating how the first and second coil parts 100 and 200 overlap each other as viewed from the surface 11*a* side of the insulating substrate 11.

As illustrated in FIG. 4, the first and second coil parts 100 and 200 are formed on the front and back surfaces of the insulating substrate 11, respectively, such that the center points C thereof coincide with each other and that the terminal electrodes E1*a* and E2*a* overlap the terminal electrodes E1*b* and E2*b*, respectively. As a result, the circumferential regions A1 of the respective turns 110, 120, 130, 140, 150, and 160 constituting the first coil part 100 and the circumferential regions A2 of the respective turns 210, 220, 230, 240, 250, and 260 constituting the second coil part 200 overlap each other for the most part in a plan view. Further, the inner peripheral end of the turn 150 of the first coil part 100 and the inner peripheral end of the turn 260 of the second coil part 200 are connected to each other through the connection part THa1 penetrating the insulating substrate 11, and the inner peripheral end of the turn 160 of the first coil part 100 and the inner peripheral end of the turn 250 of the second coil part 200 are connected to each other through the connection part THa2 penetrating the insulating substrate 11.

Further, the lead-out patterns 191 and 291 are connected to each other through connection parts THb penetrating the insulating substrate 11. Similarly, the lead-out patterns 192 and 292 are connected to each other through connection parts THc penetrating the insulating substrate 11. As a result, the terminal electrodes E1*a* and E1*b* are short-circuited, and the terminal electrodes E2*a* and E2*b* are short-circuited. Although one connection part THa1, one connection part THa2, three connection parts THb, and three connection parts THc are formed in the present embodiment, the number of each of the connection parts is not particularly limited.

Figure 5:
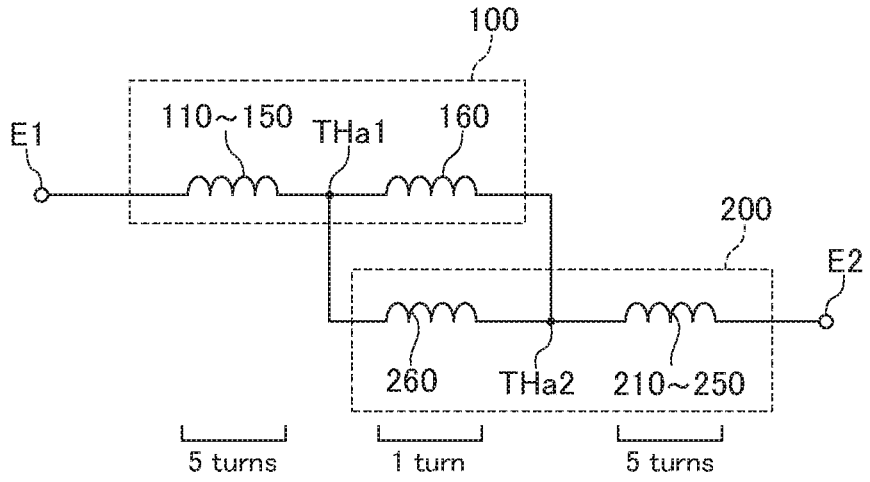
FIG. 5 is an equivalent circuit diagram of the coil component according to the first embodiment of the present invention.

FIG. 5 is an equivalent circuit diagram of the coil component according to the present embodiment.

As illustrated in FIG. 5, the first and second coil parts 100 and 200 are basically connected in series between a terminal electrode E1 constituted of the terminal electrodes E1*a* and E1*b* and a terminal electrode E2 constituted of the terminal electrodes E2*a* and E2*b*. However, the innermost turns 160 and 260 are connected in parallel, so that they equivalently constitute one turn. As a result, the coil component according to the present embodiment has 11 turns in total. Thus, it is possible to set the total number of turns to an odd number even when the number of turns of each of the first and second coil parts 100 and 200 is an integer value (six).

Although the turns 160 and 260 are connected in parallel, the conductor width of each of the turns 160 and 260 is smaller than (preferably, half) those of the other turns, so that the electrical characteristics of these turns 160 and 260 can be regarded to be identical with those of the other turns.

Further, the coil component according to the present embodiment is constituted of the first and second coil parts 100 and 200 having the same planar shape, so that the first and second coil parts 100 and 200 can be manufactured using the mask having the same pattern shape, allowing manufacturing cost to be significantly reduced. In addition, the first and second coil parts 100 and 200 overlap each other for the most part in a plan view excluding a portion overlapping the shift regions B1 and B2, so that even when the insulating substrate 11 is transparent or translucent, visual interference between the first and second coil parts 100 and 200 can be minimized. That is, when outer appearance of the first coil part 100 is inspected, the second coil part 200 does not serve as visual obstruction and, conversely, when outer appearance of the second coil part 200 is inspected, the first coil part 100 does not serve as visual obstruction. This allows outer appearance inspection using an outer appearance inspection device to be executed properly.

Further, in the coil component according to the present embodiment, the outer peripheral ends and the inner peripheral ends of each of the first and second coil parts 100 and 200 are disposed within the shift region (B1, B2). Thus, although the outer peripheral end of the first coil part 100 and the outer peripheral end of the second coil part 200 are disposed adjacent to each other, it is possible to prevent increase in the size of the outer shape of the coil part or reduction in the size of the coil inner diameter region due to enlargement of the circumferential regions A1 and A2.

Second Embodiment

Next, a coil component according to the second embodiment will be described. The coil component according to the second embodiment differs from the coil component according to the first embodiment in that the above-described first and second coil parts 100 and 200 are replaced by first and second coil parts 100A and 200A. Other configurations are basically the same as those of the coil component according to the first embodiment, so the same reference numerals are given to the same elements, and overlapping description will be omitted.

Figure 6:
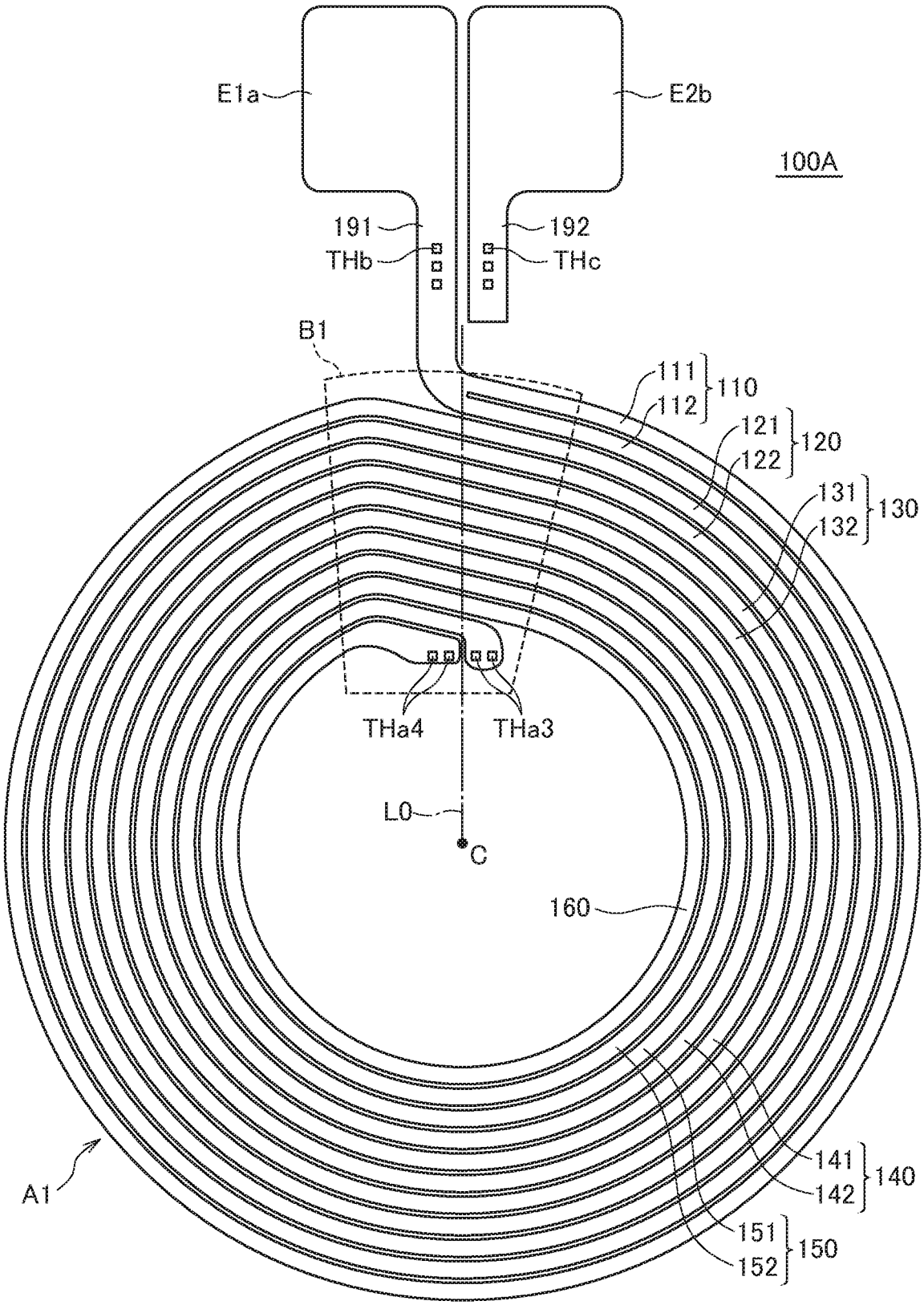
FIG. 6 is a plan view illustrating the pattern shape of a first coil part according to a second embodiment of the present invention.
Figure 7:
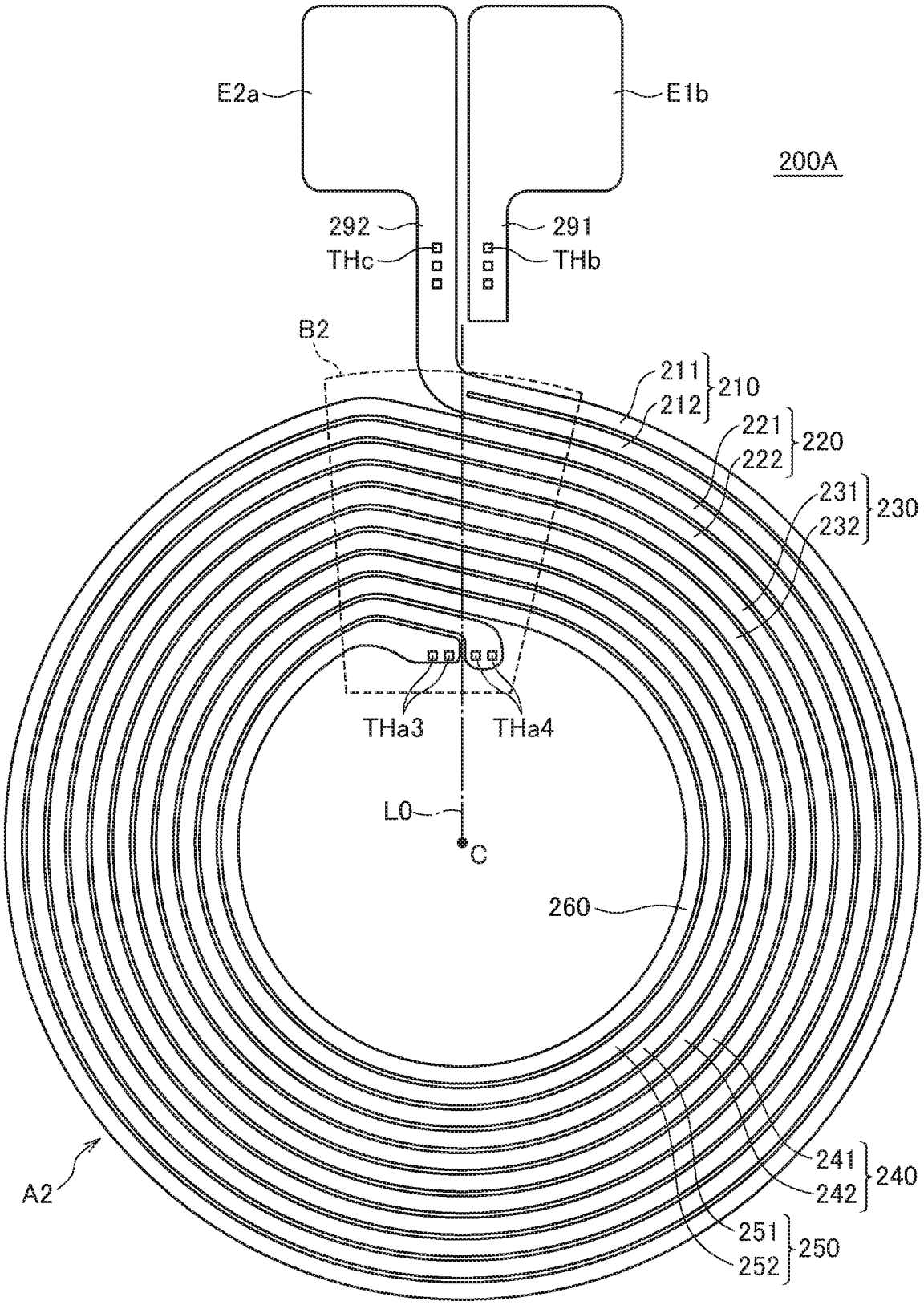
FIG. 7 is a plan view illustrating the pattern shape of a second coil part according to the second embodiment of the present invention.

FIG. 6 is a plan view illustrating the pattern shape of the first coil part 100A as viewed from the surface 11*a* side of the insulating substrate 11. FIG. 7 is a plan view illustrating the pattern shape of the second coil part 200A as viewed from the surface 11*b* side of the insulating substrate 11. Also in the present embodiment, the first and second coil parts 100A and 200A have the same pattern shape.

As illustrated in FIG. 6, the first coil part 100A has six turns including the turns 110, 120, 130, 140, 150, and 160. Among them, the turns 110, 120, 130, 140, and 150 are each radially separated by a spiral-shaped slit. Specifically, the turn 110 is separated into two lines 111 and 112, the turn 120 is separated into two lines 121 and 122, the turn 130 is separated into two lines 131 and 132, the turn 140 is separated into two lines 141 and 142, and the turn 150 is separated into two lines 151 and 152. The lines 111, 121, 131, 141, and 151 are positioned on the outer peripheral side relative to the lines 112, 122, 132, 142, and 152, respectively.

Of the lines 151 and 152 constituting the turn 150, the inner peripheral side line 152 has an inner peripheral end terminated and connected to a connection part THa3; on the other hand, the outer peripheral side line 151 is continuously wound to constitute the turn 160. The inner peripheral end of the turn 160 is connected to a connection part THa4. The turn 160 has the same conductor width as that of each of the lines constituting the turns 110, 120, 130, 140, and 150. Therefore, the conductor width of the turn 160 is half the effective conductor width of each of the turns 110, 120, 130, 140, and 150. Although two connection parts THa3 and two connection parts THa4 are formed in the present embodiment, the number of each of the connection parts is not particularly limited.

The second coil part 200A has the same pattern shape as the first coil part 100A. That is, the second coil part 200A has six turns including the turns 210, 220, 230, 240, 250, and to 260. Among them, the turns 210, 220, 230, 240, and 250 are each radially separated by a spiral-shaped slit. Specifically, the turn 210 is separated into two lines 211 and 212, the turn 220 is separated into two lines 221 and 222, the turn 230 is separated into two lines 231 and 232, the turn 240 is separated into two lines 241 and 242, and the turn 250 is separated into two lines 251 and 252. The lines 211, 221, 231, 241, and 251 are positioned on the outer peripheral side relative to the lines 212, 222, 232, 242, and 252, respectively.

Of the lines 251 and 252 constituting the turn 250, the inner peripheral side line 252 has an inner peripheral end terminated and connected to the connection part THa4; on the other hand, the outer peripheral side line 251 is continuously wound to constitute the turn 260. The inner peripheral end of the turn 260 is connected to the connection part THa3.

As illustrated in FIGS. 6 and 7, the connection parts THa3 and THa4 are disposed so as to be symmetrical with respect to the virtual line L0. Thus, when the first and second coil parts 100A and 200A are put one over the other through the insulating substrate 11, the inner peripheral end of the line 152 of the first coil part 100A and the inner peripheral end of the turn 260 of the second coil part 200A are connected through the connection part THa3, and the inner peripheral end of the turn 160 of the first coil part 100A and the inner peripheral end of the line 252 of the second coil part 200A are connected through the connection part THa4.

Figure 8:
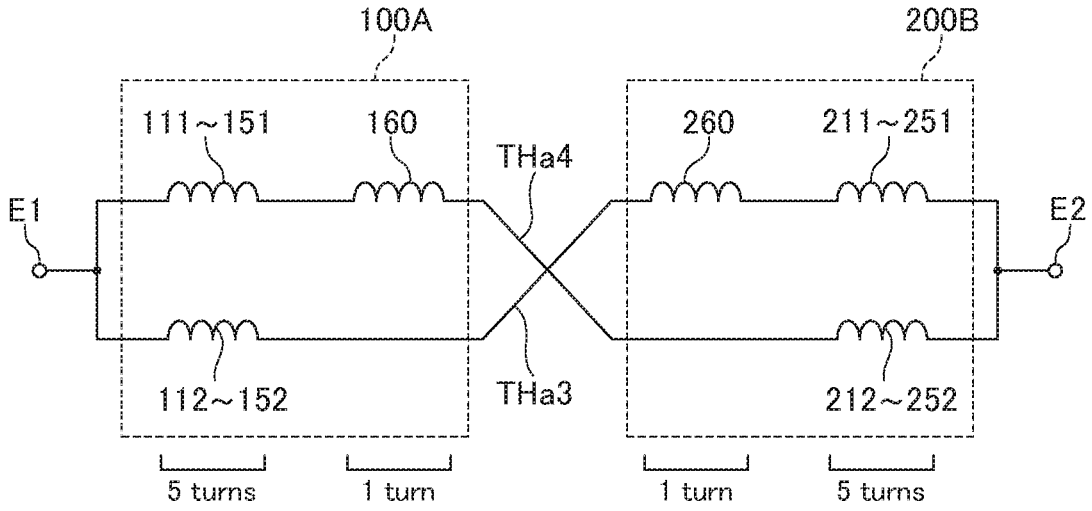
FIG. 8 is an equivalent circuit diagram of the coil component according to the second embodiment of the present invention.

FIG. 8 is an equivalent circuit diagram of the coil component according to the present embodiment.

As illustrated in FIG. 8, in the present embodiment, two conductors are connected in parallel between the terminal electrodes E1 and E2. One of the two conductors has 11 turns including the lines 111, 121, 131, 141 and 151, turn 160, and lines 252, 242, 232, 222, and 212. The other one of them has 11 turns including the lines 112, 122, 132, 142 and 152, turn 260, and lines 251, 241, 231, 221, and 211. That is, two coils each having 11 turns are connected in parallel.

With the above configuration, as in the first embodiment, it is possible to set the total number of turns to an odd number even when the number of turns of each of the first and second coil parts 100A and 200A is an integer value (six). In addition, in the coil component according to the present embodiment, the turns other than the innermost turns 160 and 260 are each radially separated by the spiral-shaped slit, so that non-uniformity of current density is reduced as compared to the first embodiment. As a result, DC resistance or AC resistance can be reduced. In addition, the outer peripheral side lines 111, 121, 131, 141, and 151 of the first coil part 100A are connected to the inner peripheral side lines 212, 222, 232, 242, and 252 of the second coil part 200A, and the inner peripheral side lines 112, 122, 132, 142, and 152 of the first coil part 100A are connected to the outer peripheral side lines 211, 221, 231, 241, and 251 of the second coil part 200A, thereby canceling the inner/outer peripheral difference. This further uniformizes current density distribution, allowing further reduction in DC resistance or AC resistance.

Further, the second embodiment being compared with the first embodiment, the positions of the terminal electrodes E1*a* and E1*b*, and the positions of the terminal electrodes E2*a* and E2*b* are interchanged. Thus, in the present invention, the positional relationship between the terminal electrodes E1*a* and E1*b* and that between the terminal electrodes E2*a* and E2*b* can arbitrarily be set.

Third Embodiment

Next, a coil component according to the third embodiment will be described. The coil component according to the third embodiment differs from the coil component according to the second embodiment in that the above-described first and second coil parts 100A and 200A are replaced by first and second coil parts 100B and 200B. Other configurations are basically the same as those of the coil component according to the second embodiment, so the same reference numerals are given to the same elements, and overlapping description will be omitted.

Figure 9:
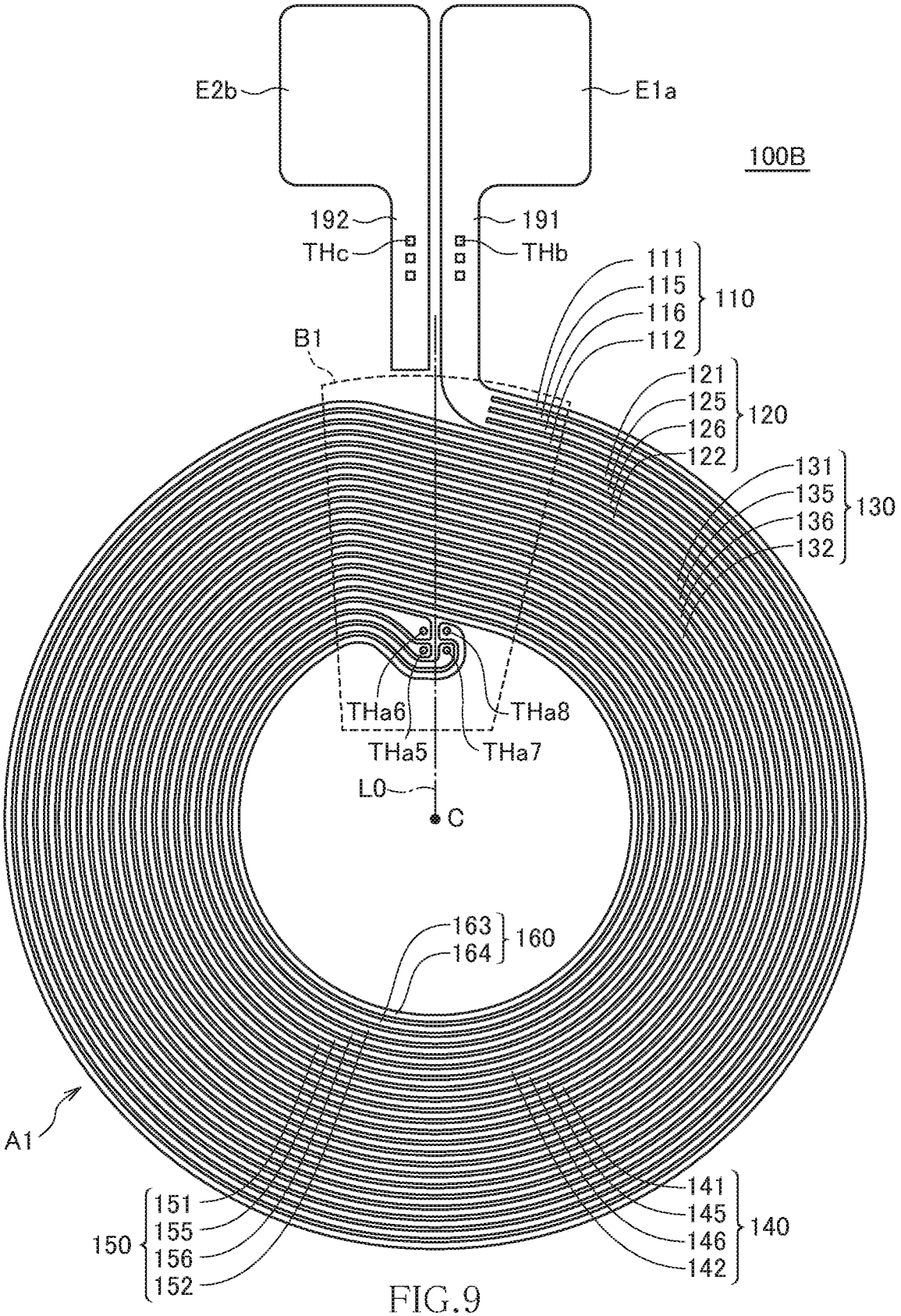
FIG. 9 is a plan view illustrating the pattern shape of a first coil part according to a third embodiment of the present invention.
Figure 10:
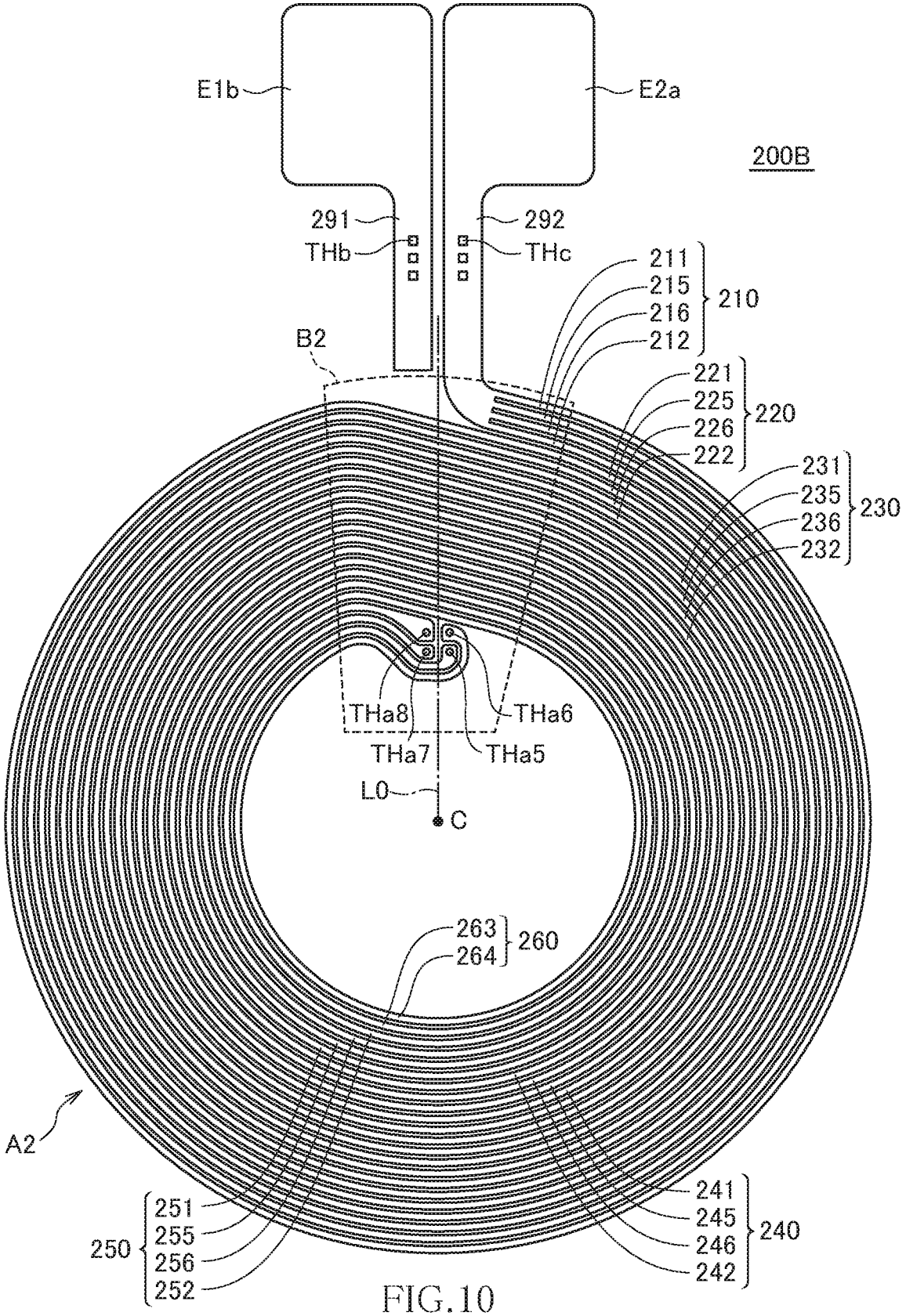
FIG. 10 is a plan view illustrating the pattern shape of a second coil part according to the third embodiment of the present invention.

FIG. 9 is a plan view illustrating the pattern shape of the first coil part 100B as viewed from the surface 11*a* side of the insulating substrate 11. FIG. 10 is a plan view illustrating the pattern shape of the second coil part 200B as viewed from the surface 11*b* side of the insulating substrate 11. Also in the present embodiment, the first and second coil parts 100B and 200B have the same pattern shape.

As illustrated in FIG. 9, the first coil part 100B has six turns including the turns 110, 120, 130, 140, 150, and to 160. Among them, the turns 110, 120, 130, 140, and 150 are each radially separated into four lines by spiral-shaped slits, and the innermost turn 160 is spirally separated into two lines by a spiral-shaped slit. Specifically, the turn 110 is separated into four lines 111, 115, 116, and 112 in this order, the turn 120 is separated into four lines 121, 125, 126, and 122 in this order, the turn 130 is separated into four lines 131, 135, 136, and 132 in this order, the turn 140 is separated into four lines 141, 145, 146, and 142 in this order, the turn 150 is separated into four lines 151, 155, 156, and 152 in this order, and the turn 160 is separated into two lines 163 and 164 in this order.

Of the lines 151, 155, 156, and 152 constituting the turn 150, the innermost line 152 has an inner peripheral end terminated and connected to a connection part THa5, and the second innermost line 156 has an inner peripheral end terminated and connected to a connection part THa6; on the other hand, the outermost line 151 is continuously wound to constitute the line 163, and the second outermost line 155 is continuously wound to constitute the line 164. The inner peripheral ends of the respective lines 163 and 164 are connected to connection parts THa7 and THa8, respectively. The lines 163 and 164 each have the same conductor width as that of each of the lines constituting the turns 110, 120, 130, 140, and 150. Therefore, the effective conductor width of the turn 160 is half the effective conductor width of each of the turns 110, 120, 130, 140, and 150. Although one connection part THa5, one connection part THa6, one connection part THa7, and one connection part THa8 are formed in the present embodiment, the number of each of the connection parts is not particularly limited.

The second coil part 200B has the same pattern shape as the first coil part 100B. That is, the second coil part 200B has six turns including the turns 210, 220, 230, 240, 250, and 260. Among them, the turns 210, 220, 230, 240, and 250 are each radially separated into four lines by spiral-shaped slits, and the innermost turn 260 is spirally separated into two lines by a spiral-shaped slit. Specifically, the turn 210 is separated into four lines 211, 215, 216, and 212 in this order, the turn 220 is separated into four lines 221, 225, 226, and 222 in this order, the turn 230 is separated into four lines 231, 235, 236, and 232 in this order, the turn 240 is separated into four lines 241, 245, 246, and 242 in this order, the turn 250 is separated into four lines 251, 255, 256, and 252 in this order, and the turn 260 is separated into two lines 263 and 264 in this order.

Of the lines 251, 255, 256, and 252 constituting the turn 250, the innermost line 252 has an inner peripheral end terminated and connected to the connection part THa7, and the second innermost line 256 has an inner peripheral end terminated and connected to the connection part THa8; on the other hand, the outermost line 251 is continuously wound to constitute the line 263, and the second outermost line 255 is continuously wound to constitute the line 264. The inner peripheral ends of the respective lines 263 and 264 are connected to connection parts THa5 and THa6, respectively.

As illustrated in FIGS. 9 and 10, the connection parts THa5 and THa7 are disposed so as to be symmetrical with respect to the virtual line L0, and the connection parts THa6 and THa8 are disposed so as to be symmetrical with respect to the virtual line L0. Thus, when the first and second coil parts 100B and 200B are put one over the other through the insulating substrate 11, the inner peripheral end of the line 152 of the first coil part 100B and the inner peripheral end of the line 263 of the second coil part 200B are connected through the connection part THa5, the inner peripheral end of the line 156 of the first coil part 100B and the inner peripheral end of the line 264 of the second coil part 200B are connected through the connection part THa6, the inner peripheral end of the line 163 of the first coil part 100B and the inner peripheral end of the line 252 of the second coil part 200B are connected through the connection part THa7, and the inner peripheral end of the line 164 of the first coil part 100B and the inner peripheral end of the line 256 of the second coil part 200B are connected through the connection part THa8.

Figure 11:
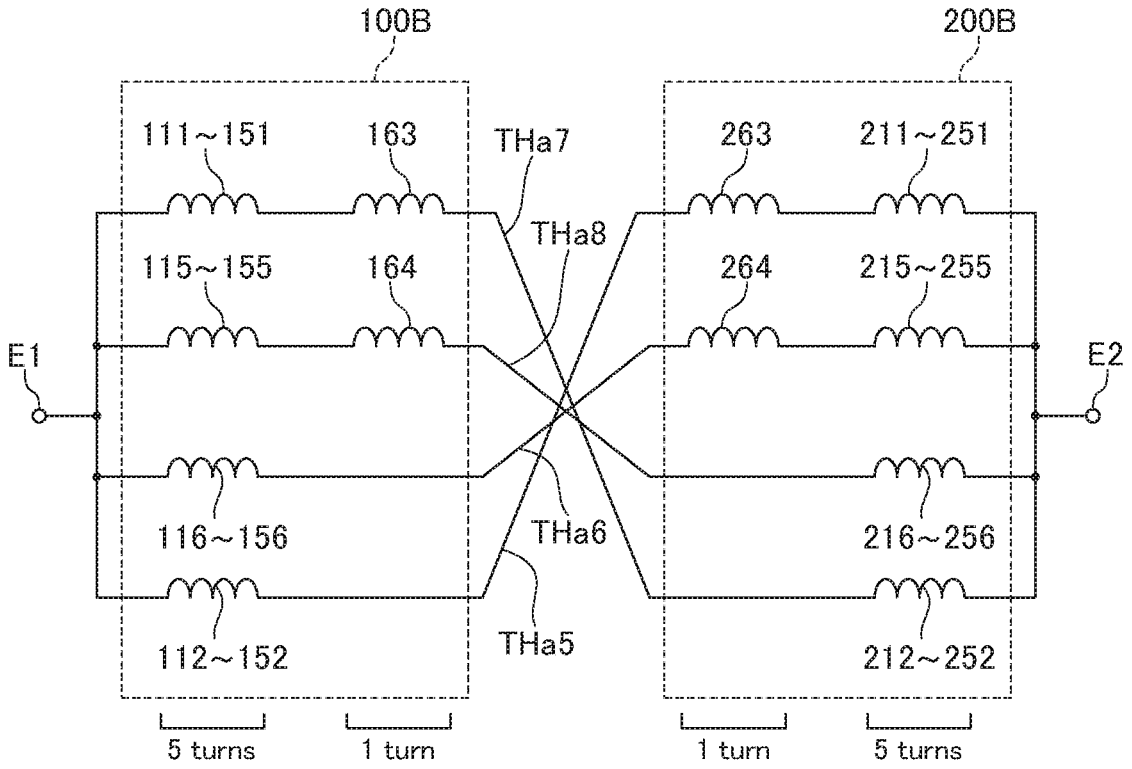
FIG. 11 is an equivalent circuit diagram of the coil component according to the third embodiment of the present invention.

FIG. 11 is an equivalent circuit diagram of the coil component according to the present embodiment.

As illustrated in FIG. 11, in the present embodiment, four (first to fourth) conductors are connected in parallel between the terminal electrodes E1 and E2. The first conductor has 11 turns including the lines 111, 121, 131, 141, 151, 163, 252, 242, 232, 222, and 212. The second conductor has 11 turns including the lines 115, 125, 135, 145, 155, 164, 256, 246, 236, 226, and 216. The third conductor has 11 turns including the lines 116, 126, 136, 146, 156, 264, 255, 245, 235, 225, and 215. The fourth conductor has 11 turns including the lines 112, 122, 132, 142, 152, 263, 251, 241, 231, 221, and 211. That is, four coils each having 11 turns are connected in parallel.

With the above configuration, as in the first and second embodiments, it is possible to set the total number of turns to an odd number even when the number of turns of each of the first and second coil parts 100A and 200A is an integer value (six). In addition, in the coil component according to the present embodiment, the turns other than the innermost turns 160 and 260 are each radially separated into four lines by the spiral-shaped slits, and the innermost turns 160 and 260 are each radially separated into two lines by the spiral-shaped slit, so that non-uniformity of current density is further reduced as compared to the second embodiment. As a result, DC resistance or AC resistance can be further reduced. In addition, the outermost lines 111, 121, 131, 141, and 151 of the first coil part 100B are connected respectively to the innermost lines 212, 222, 232, 242, and 252 of the second coil part 200B, the second outermost lines 115, 125, 135, 145, and 155 of the first coil part 100B are connected respectively to the second innermost lines 216, 226, 236, 246, and 256 of the second coil part 200B, the second innermost lines 116, 126, 136, 146, and 156 of the first coil part 100B are connected respectively to the second outermost lines 215, 225, 235, 245, and 255 of the second coil part 200B, and the innermost lines 112, 122, 132, 142, and 152 of the first coil part 100B are connected respectively to the outermost lines 211, 221, 231, 241, and 251 of the second coil part 200B, thereby correctly canceling the inner/outer peripheral difference. This further uniformizes current density distribution, allowing further reduction in DC resistance or AC resistance.

Fourth Embodiment

Next, a coil component according to the fourth embodiment will be described. The coil component according to the fourth embodiment differs from the coil components according to the second and third embodiments in that the above-described first coil part 100A or 100B is replaced by a first coil part 100C, and the second coil part 200A or 200B is replaced by a second coil part 200C. Other configurations are basically the same as those of the coil component according to the second and third embodiments, so the same reference numerals are given to the same elements, and overlapping description will be omitted.

Figure 12:
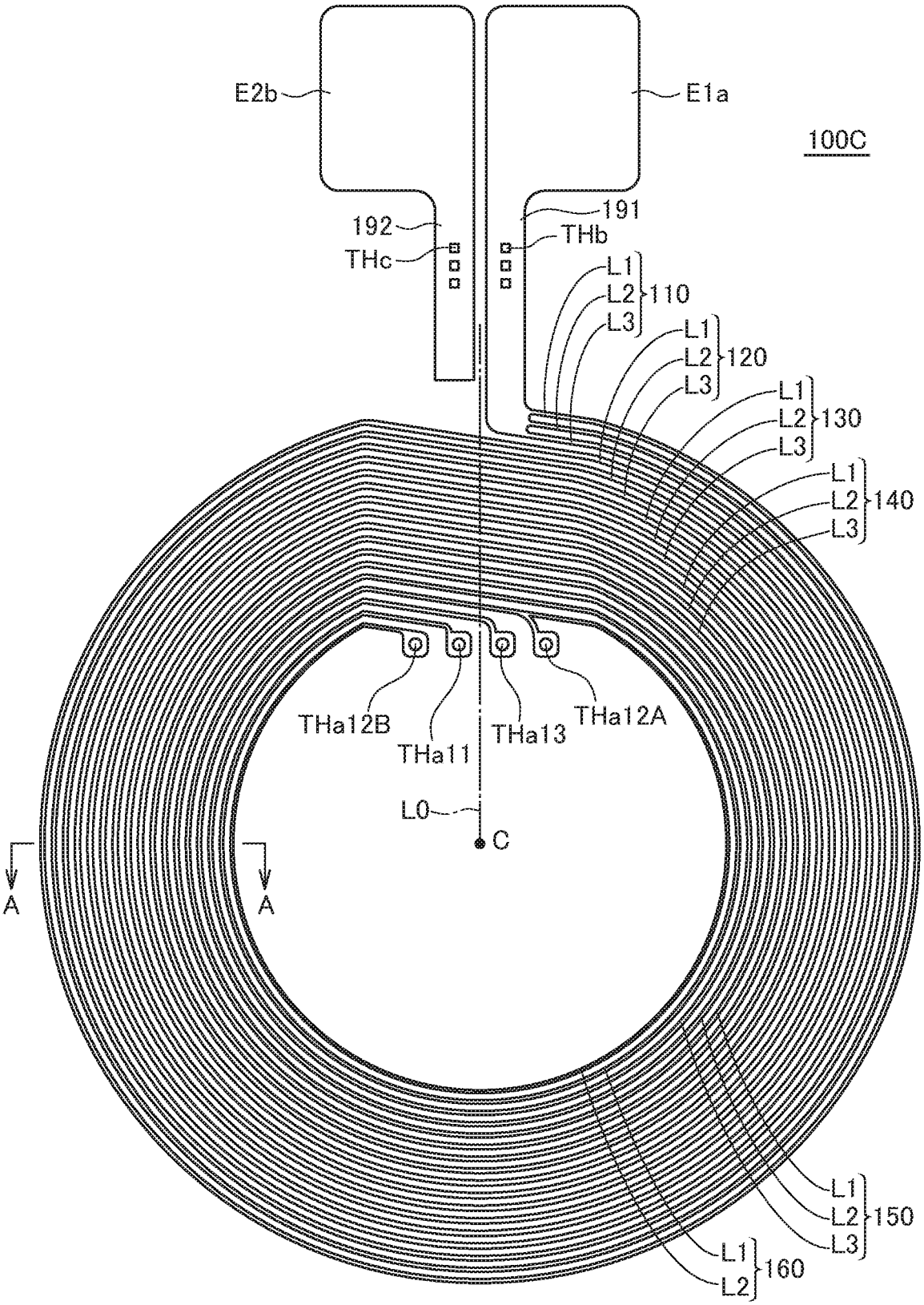
FIG. 12 is a plan view illustrating the pattern shape of a first coil part according to a fourth embodiment of the present invention.
Figure 13:
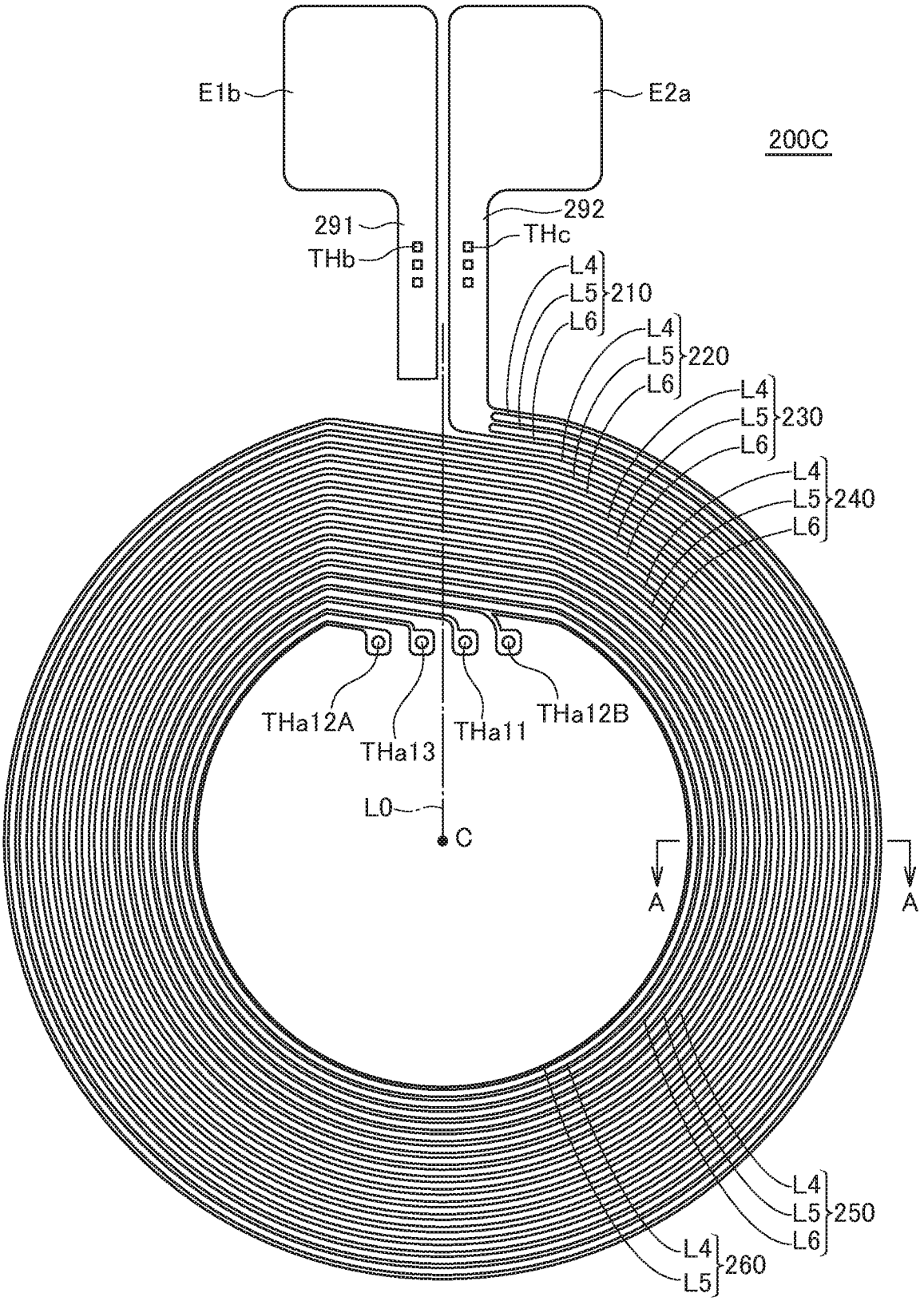
FIG. 13 is a plan view illustrating the pattern shape of a second coil part according to the fourth embodiment of the present invention.

FIG. 12 is a plan view illustrating the pattern shape of the first coil part 100C as viewed from the surface 11*a* side of the insulating substrate 11. FIG. 13 is a plan view illustrating the pattern shape of the second coil part 200C as viewed from the surface 11*b* side of the insulating substrate 11. Also in the present embodiment, the first and second coil parts 100C and 200C have the same pattern shape.

As illustrated in FIG. 12, the first coil part 100C has six turns including the turns 110, 120, 130, 140, 150, and 160. Among them, the turns 110, 120, 130, 140, and 150 are each radially separated into three lines by spiral-shaped slits, and the innermost turn 160 is spirally separated into two lines by a spiral-shaped slit. Specifically, the turns 110, 120, 130, 140, and 150 are each separated into three lines L1 to L3 in this order, and the turn 160 is separated into two lines L1 and L2 in this order.

Of the lines L1 to L3 constituting the turn 150, the innermost line L3 has an inner peripheral end terminated and connected to a connection part THa13; on the other hand, the outermost line L1 is continuously wound to constitute the line L1 of the turn 160, and the inner peripheral end thereof is connected to a connection part THa11. Further, of the lines L1 to L3 constituting the turn 150, the line L2 sandwiched between the lines L1 and L3 has an inner peripheral end branched into two parts, and one of the branched parts is connected to a connection part THa12A, and the other one thereof is continuously wound to constitute the line L2 of the turn 160, and the inner peripheral end of the line L2 is connected to a connection part THa12B.

As described above, the line L2 is connected to two mutually different connection parts THa12A and THa12B, and the line L2 of the turn 160 constitutes a section connecting the two connection parts THa12A and THa12B. Although the connection part THa12A is positioned at the start point of the line L2 of the turn 160 (i.e., the end point of the line L2 of the turn 150) in the present embodiment, it may be positioned in the middle of the line L2 of the turn 160 or in the middle of the line L2 of the turn 150.

The second coil part 200B has the same pattern shape as the first coil part 100C. That is, the second coil part 200C has six turns including the turns 210, 220, 230, 240, 250, and 260. Among them, the turns 210, 220, 230, 240, and 250 are each radially separated into three lines by spiral-shaped slits, and the innermost turn 260 is spirally separated into two lines by a spiral-shaped slit. Specifically, the turns 210, 220, 230, 240, and 250 are each separated into three lines L4 to L6 in this order, and the turn 260 is separated into two lines L4 and L5 in this order.

Of the lines L4 to L6 constituting the turn 250, the innermost line L6 has an inner peripheral end terminated and connected to the connection part THa11; on the other hand, the outermost line L4 is continuously wound to constitute the line L4 of the turn 260, and the inner peripheral end thereof is connected to the connection part THa13. Further, of the lines L4 to L6 constituting the turn 250, the line L5 sandwiched between the lines L4 and L6 has an inner peripheral end branched into two parts, and one of the branched parts is connected to the connection part THa12B, and the other one thereof is continuously wound to constitute the line L5 of the turn 260, and the inner peripheral end of the line L5 is connected to the connection part THa12A.

As described above, the line L5 is connected to two mutually different connection parts THa12A and THa12B, and the line L5 of the turn 260 constitutes a section connecting the two connection parts THa12A and THa12B. Although the connection part THa12B is positioned at the start point of the line L5 of the turn 260 (i.e., the end point of the line L5 of the turn 250) in the present embodiment, it may be positioned in the middle of the line L5 of the turn 260 or in the middle of the line L5 of the turn 250.

As illustrated in FIGS. 12 and 13, the connection parts THa11 and THa13 are disposed so as to be symmetrical with respect to the virtual line L0, and the connection parts THa12A and THa12B are disposed so as to be symmetrical with respect to the virtual line L0. Thus, when the first and second coil parts 100C and 200C are put one over the other through the insulating substrate 11, the inner peripheral end of the line L1 of the turn 160 and the inner peripheral end of the line L6 of the turn 250 are connected through the connection part THa11, the inner peripheral end of the line L3 of the turn 150 and the inner peripheral end of the line L4 of the turn 260 are connected through the connection part THa13, the inner peripheral end of the line L2 of the turn 150 and the inner peripheral end of the line L5 of the turn 260 are connected through the connection part THa12A, and the inner peripheral end of the line L2 of the turn 160 and the inner peripheral end of the line L5 of the turn 250 are connected through the connection part THa12B.

Figure 14:
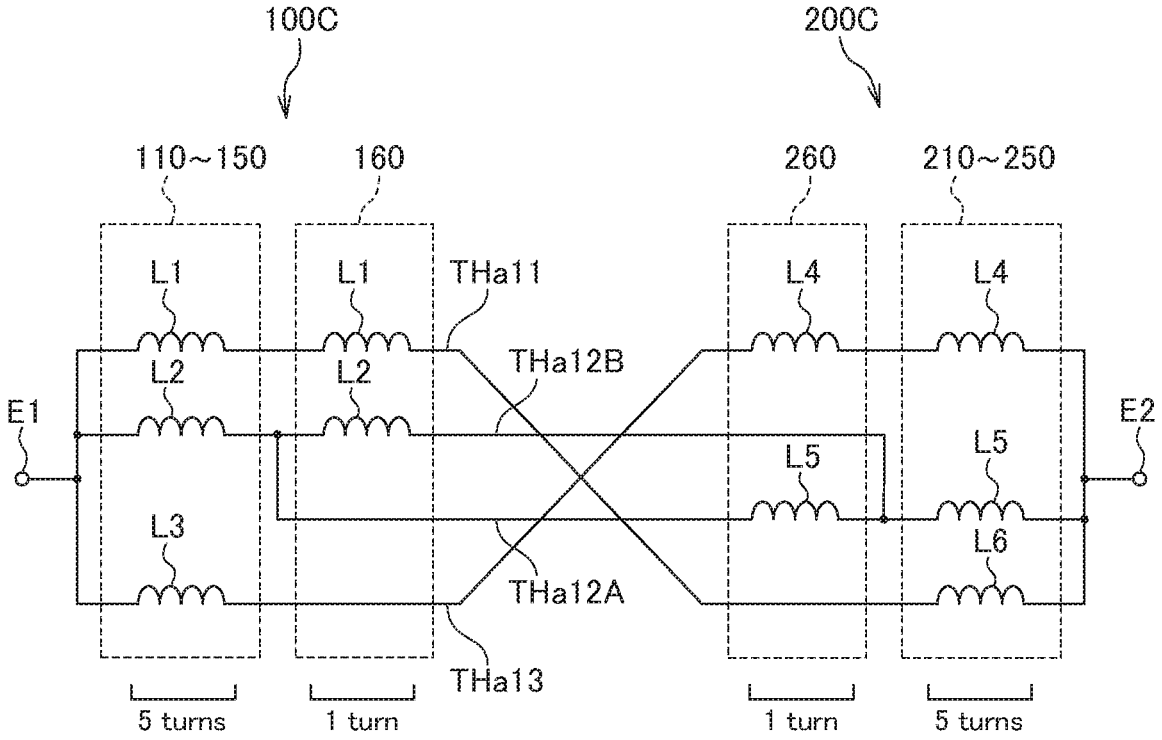
FIG. 14 is an equivalent circuit diagram of the coil component according to the fourth embodiment of the present invention.

FIG. 14 is an equivalent circuit diagram of the coil component according to the present embodiment.

As illustrated in FIG. 14, in the present embodiment, three (first to third) conductors are connected in parallel between the terminal electrodes E1 and E2. The first conductor has 11 turns including the lines L1 and L6. The second conductor has 11 turns including the lines L2 and L5. The third conductor has 11 turns including the lines L3 and L4. That is, three coils each having 11 turns are connected in parallel.

With the above configuration, as in the first to third embodiments, it is possible to set the total number of turns to an odd number even when the number of turns of each of the first and second coil parts 100C and 200C is an integer value (six). In addition, in the coil component according to the present embodiment, the turns other than the innermost turns 160 and 260 are each radially separated into three lines by the spiral-shaped slits, and the innermost turns 160 and 260 are each radially separated into two lines by the spiral-shaped slit, so that non-uniformity of current density is further reduced as compared to the second embodiment. As a result, DC resistance or AC resistance can be further reduced. In addition, the outermost line L1 of the first coil part 100C is connected to the innermost line L6 of the second coil part 200C, the innermost line L3 of the first coil part 100C is connected to the outermost line L4 of the second coil part 200C, and the line L2 positioned between the lines L1 and L3 of the first coil part 100C is connected to the line L5 positioned between the lines L4 and L6 of the second coil part 200C, thereby correctly canceling the inner/outer peripheral difference. This further uniformizes current density distribution, allowing further reduction in DC resistance or AC resistance.

The turn 160 of the first coil part 100C includes the line L2, and the turn 260 of the second coil part 200C includes the line L5, and the lines L2 and L5 are connected in parallel, so that the turns 160 and 260 can each be regarded as one turn. Originally, in order to realize one turn, it is sufficient that only one of the line L2 of the turn 160 and the line L5 of the turn 260 exists; however, when one of the line L2 of the turn 160 and the line L5 of the turn 260 is omitted, the pattern shapes of the first and second coil parts 100C and 200C become different from each other, failing to manufacture the first and second coil parts 100C and 200C using a mask having the same pattern shape. In view of this, in the present embodiment, both the line L2 of the turn 160 and the line L5 of the turn 260 are used and connected in parallel, whereby it is possible to realize one turn while making the pattern shapes of the first and second coil parts 100 and 200 identical with each other.

In a case where the total number of turns is set to an odd number, and where the number of separations of each turn is set to an odd number, as described above, how the line positioned intermediate in the radial direction (in the present embodiment, line L2 or line L5) is treated is a problem. To cope with this, in the present embodiment, the innermost turns of the intermediate lines are connected in parallel, whereby it is possible to set the total number of turns to an odd number while making the pattern shapes of the front and back coil parts identical with each other. Thus, the present embodiment can be applied not only to a case where each turn is separated into three lines, but also to all the cases where the number of separations of each turn is set to an odd number (five, seven, or the like).

In the present embodiment, the innermost turn of the line L2 and the innermost turn of the line L5 are connected in parallel, so that assuming that the conductor widths of all the turns are constant, the resistance value becomes locally low at this portion, which may cause imbalance between the lines. In order to prevent this, the conductor widths of the innermost turn of the line L2 and the innermost turn of the line L5 are preferably set smaller than those of other lines. For example, when the conductor widths of the innermost turn of the line L2 and the innermost turn of the line L5 are set to half the conductor widths of the other lines, it is possible to keep balance between the lines. Alternatively, the balance between the lines can also be kept by making the conductor widths of the lines L2 and L5 slightly smaller as a whole than the conductor widths of the lines L1, L3, L4, and L6.

Figure 15:
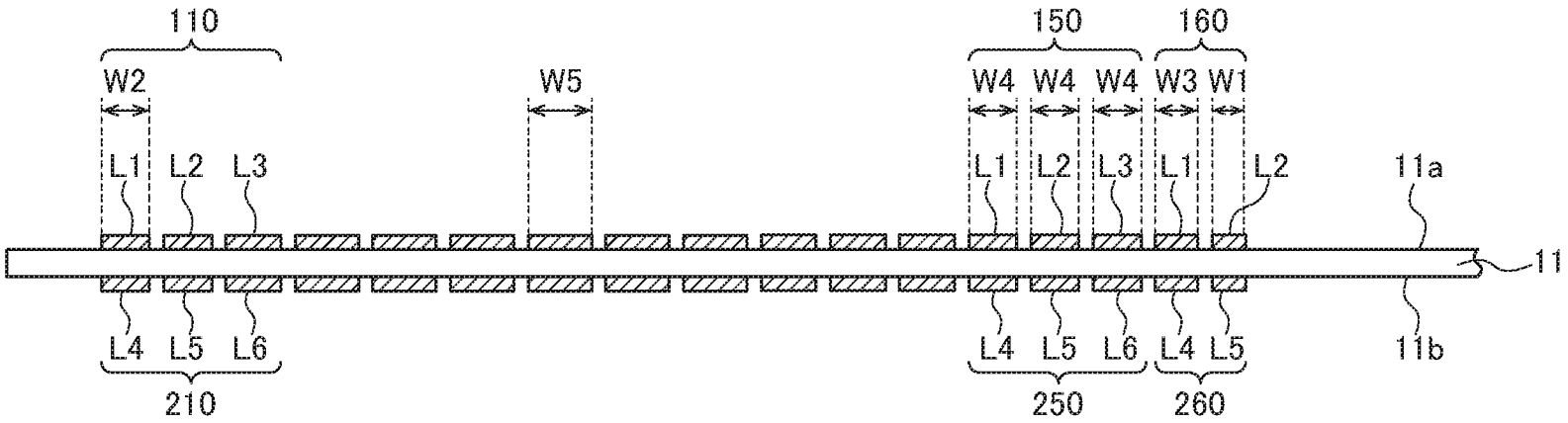
FIG. 15 is a schematic cross-sectional view taken along line A-A of FIGS. 12 and 13.

FIG. 15 is a schematic cross-sectional view taken along line A-A of FIGS. 12 and 13.

In the example of FIG. 15, the first and second coil parts 100C and 200C are each varied in pattern width in the radial direction such that the pattern width is smaller on the inner and outer peripheral sides and larger on the center side.

More specifically, assuming that the pattern width of each of the lines L2 and L5 positioned on the inner peripheral sides of the respective innermost turns 160 and 260 is W1, that the pattern width of each of the lines L1 and L4 positioned on the outermost peripheral sides of the respective outermost turns 110 and 210 is W2, and that the pattern width of the turn positioned substantially intermediate is W5, W1, W2<W5 is satisfied, and preferably, W1<W2<W5 is satisfied.

The reason for reduction in the pattern widths W1 and W2 of the respective innermost and outermost turns is that a magnetic field is strong at these portions to generate a large loss due to heat generation caused by eddy current. That is, the reduction in the pattern widths W1 and W2 of the respective innermost and outermost turns reduces magnetic flux interfering with the innermost and outermost turns, thereby making it possible to reduce the eddy current being generated. In particular, the innermost turn is positioned at a region where the magnetic flux is the strongest, the pattern width W1 at this portion is preferably made smaller. However, the pattern width W1 of the innermost turn is preferably larger than the pattern thickness of each of the first and second coil parts 100C and 200C. This causes the eddy current flowing in the coil parts 100C and 200C to concentrate on radially opposite sides of the conductor pattern, so that it is possible to obtain a remarkable effect of reducing loss caused due to the reduction in the pattern width of each of the first and second coil parts 100C and 200C.

In addition, as described above, the lines L2 and L5 of the respective innermost turns 160 and 260 are connected in parallel, so that the reduction in the pattern width W1 allows balance between the lines to be kept.

The line pattern width is preferably made larger gradually or stepwise from the innermost and outermost peripheries to substantially the center portion. For example, assuming that the pattern width of each of the lines L1 and L4 of the respective turns 160 and 260 is W3 and that the pattern width of each of the lines L1 to L6 of the turns 150 and 250 is W4, W1<W3<W4<W5 is preferably satisfied.

The pattern widths of the three lines constituting one turn may be mutually the same; however, even when only the pattern width of each of the intermediate lines L2 and L5 is reduced, it is possible to keep balance between the lines.

Further, the conductor pattern thickness may be smaller in the innermost turn than in the outermost pattern. In particular, the pattern thickness is preferably smaller gradually or stepwise from the outermost turn to the innermost turn. This makes it possible to obtain a remarkable effect of reducing loss caused due to the reduction in the pattern width at the inner peripheral side having a greater influence of the eddy current.

As described above, in the coil component according to the present embodiment, the line L2 included in the first coil part 100C and the line L5 included in the second coil part 200C are connected through the two connection parts THa12A and THa12B. Thus, the total number of turns can be set to an odd number although the first and second coil parts 100 and 200 have the same pattern shape, the number of turns of each coil part is an integer value, and the number of separations of each turn is an odd number.

Figure 16A:
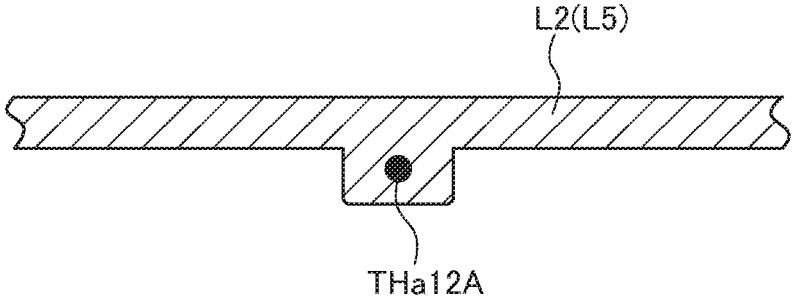
FIGS. 16A and 16B are plan views indicating the connection part according to modifications.
Figure 16B:
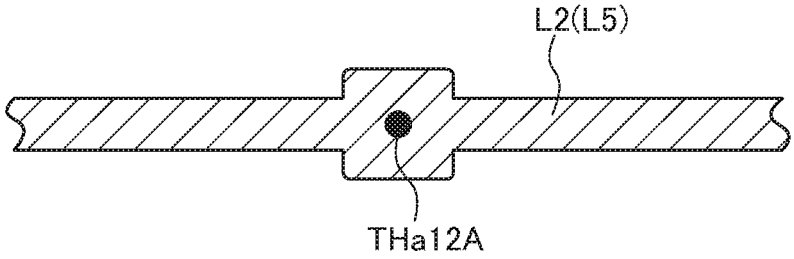

In the example illustrated in FIGS. 12 and 13, the lines L2 and L5 are each branched at the start point of the innermost turn; however, they may not necessarily be branched. For example, as exemplified in FIGS. 16A and 16B, the pattern width of each of the lines L2 and L5 may be partially enlarged so as to form the connection part THa12A at this portion.

It is apparent that the present invention is not limited to the above embodiments, but may be modified and changed without departing from the scope and spirit of the invention.

For example, although the two coil parts are formed on the front and back surfaces of the insulating substrate in the above embodiments, this is not essential in the present invention. Further, although the two coil parts mutually have the same shape in the above embodiments, this is also not essential in the present embodiment.

Further, although each of the turns constituting the first and second coil parts 100A and 200A is radially separated into two lines in the second embodiment, each of the turns constituting the first and second coil parts 100B and 200B is radially separated into four lines in the third embodiment, and each of the turns constituting the first and second coil parts 100C and 200C is radially separated into three lines in the fourth embodiment, the number of separations is not particularly limited. The current density distribution becomes more uniform as the number of separations becomes larger; on the other hand, increase in the number of separations increases the occupancy area of the slit, so that the conductor area per turn is reduced, which may increase DC resistance. Considering this point, the number of separations is preferably set to three to eight. The actual number of separations may be determined by the frequency of current flowing through the coil component, and it is preferable to reduce the number of separations as the frequency band becomes low and to increase the number of separations as the frequency band becomes high. In particular, when the coil component according to the present invention is used as a receiving coil for a wireless power transmission system, the frequency of AC power to receive is 30 kHz to 150 kHz. In this case, the optimum number of separations is three or four. Further, each of the turns constituting the first and second coil parts 100 and 200 is not separated as in the first embodiment, reduction in the conductor width due to the presence of the slit does not occur to minimize the DC resistance although the effect of decentralizing the current density distribution cannot be obtained.

What is claimed is:

1. A coil component comprising:

a first coil part spirally wound in a plurality of turns, the first coil part including a first turn positioned at an innermost periphery of the first coil part and a second turn positioned on an outer peripheral side of the first coil part relative to the first turn, the first turn being wound substantially in one turn; and a second coil part spirally wound in a plurality of turns, the second coil part including a third turn positioned at an innermost periphery of the second coil part and a fourth turn positioned on an outer peripheral side of the second coil part relative to the third turn, the third turn being wound substantially in one turn, wherein the first turn and the fourth turn are connected to each other, and the second turn and the third turn are connected to each other, wherein each of the turns of the first coil part other than the first turn is radially separated, by a first spiral-shaped slit, into a first line and a second line that is disposed at an outer peripheral side of the first line, wherein each of the turns of the second coil part other than the third turn is radially separated, by a second spiral-shaped slit, into a first line and a second line that is disposed at an outer peripheral side of the first line, wherein the first turn is a turn continued from the first line of the second turn, and wherein the third turn is a turn continued from the first line of the fourth turn.

2. The coil component as claimed in claim 1, wherein the first turn of the first coil part is connected to the second line of the fourth turn, and wherein the third turn of the second coil part is connected to the second line of the second turn.

3. The coil component as claimed in claim 1, wherein the first coil part is formed on one surface of an insulating substrate, and the second coil part is formed on an other surface of the insulating substrate.

4. The coil component as claimed in claim 3, wherein the insulating substrate is transparent or translucent.

5. The coil component as claimed in claim 4, wherein the plurality of turns constituting the first and second coil parts have a circumferential region in which a radial position is not changed and a shift region in which a radial position is shifted, and wherein the circumferential regions of the plurality of turns constituting the first coil part and the circumferential regions of a plurality of turns constituting the second coil part coincide with each other in planar position.

* * * * *